United States Patent [19]

Ridgeway

[11] Patent Number: 4,852,743

[45] Date of Patent: Aug. 1, 1989

[54] MEMBRANE PACKING

[76] Inventor: Louis H. Ridgeway, 5835 Leadrope Way, Bonita, Calif. 92002

[21] Appl. No.: 162,215

[22] Filed: Feb. 29, 1988

[51] Int. Cl.[4] ..... B65D 81/02

[52] U.S. Cl. ..... 206/583; 206/521; 206/592; 206/591; 206/526

[58] Field of Search ..... 206/485, 521, 583, 589, 206/426, 526, 527, 591, 592

[56] References Cited

U.S. PATENT DOCUMENTS

| | | | |
|---|---|---|---|
| 2,501,570 | 3/1950 | Larsen | 206/583 |
| 3,521,743 | 7/1970 | Sposito, Jr. | 206/583 |
| 3,853,220 | 12/1974 | Luray | 206/583 |
| 4,173,286 | 11/1979 | Stanko | 206/589 |
| 4,491,225 | 1/1985 | Baillod | 206/583 |
| 4,606,459 | 8/1986 | Luray | 206/583 |
| 4,606,460 | 8/1986 | Luray | 206/583 |

*Primary Examiner*—David T. Fidei
*Attorney, Agent, or Firm*—Charmasson & Holz

[57] ABSTRACT

A pair of rigid frames having central openings are each covered with a pliable and stretchable material which is forced in intimate contact with a fragile article to be handled. Central openings allow passage of the fragile article which is suspended between the two pliable materials, Stretchable material and friction limits the handling shock loads which may be transmitted to the fragile article in one direction, and cushions loads in other directions. Frames can be positioned within an enclosure package so that motion of the fragile article during handling can be tolerated. A single pair of pliable covered frames can serve as packing for a wide variety of solid materials, including multiple items, with no further protection required.

12 Claims, 1 Drawing Sheet

MEMBRANE PACKING

FIELD OF THE INVENTION

This invention relates to packaging, more specifically to wrap packaging, packing and suspension of special shape items.

BACKGROUND OF THE INVENTION

Although a retail package can be decorative and encourage purchase of the enclosed article, the primary purpose of any packaging is to protect the article from shipping and handling hazards. Auxiliary packing materials also may have other functions, but again a primary function is to protect the article. These primary functions are especially critical when shipping or handling fragile or delicate articles.

Packing for delicate, fragile, sensitive or specially configured items should be small, light weight, pleasing in appearance and low in cost. However, at the same time, the packing must be able to withstand shipping and handling loads transmitted by the external package or container without transmitting excessive amounts of these loads to the article being shipped. The packaging must also be able to perform its functions within the limitations of a difficult environment, including extremes of temperature, altitude (pressure), shock, vibration, and stacking of containers and or articles within containers.

A variety of approaches to packaging fragile articles are currently available. One approach uses a fill material within an external container. The fill material may be foam, wood chips, tissue (paper), excelsior, grey chip dunnage, dimpled kraft, foam sheeting, newspaper or elastomeric materials. A modification of this approach uses expanding materials such as foam in place compounds within a container. The fill or packing material distributes the shipping and handling loads throughout the fill material and to the many contact points with the article being shipped. A second related approach is to provide a specially shaped restraint within the container. The special shape again distributes shipping and handling loads, but does not require a complete fill within the container. The special shape may be obtained by molding or preforming the restraint to intimately surround the article. This can be accomplished by die cut material stand offs, built-pads, end caps and spacers generally made from corrugated or solid foam materials. Except for the deformation of the fill material, the full shipping and handling loads are transmitted to the fragile article.

Another approach protects the delicate article with deformable wrapping, liners, pads, sacks, crush or other materials. These materials allow very limited movement within the container (not a complete fill of the container). These flexible materials near the article may be further restrained by rigid materials within the container. Examples include struts and stays, cardboard or stiff paper, restraining a wrapped article placed in the container. Heat shrinkable films have been used as the flexible wrap to obtain good contact and encapsulation. Again, except for the very limited movement and deformation of wrapping and other materials, the full shipping and handling loads are transmitted to the wrapped fragile article.

In another approach, a preformed rigid container or package is used, allowing very little movement within the container. The container withstands the shipping and handling loads. Examples include blister packs and rolled drawing containers. These rigid or semi-rigid containers can also be attached to a card to provide a means for rack or hook display. In a modification of this approach, the container is transparent allowing the customer to view the article. In a further modification, package is not preformed, but is shrunk fit or formed around the article while the packaging material is flexible (for example using vacuum to draw a thermosetting plastic film around the article), then setting the previously flexible material to form a rigid container. This skin packaging approach immobilizes the article and completely encapsulates it. This technique is particularly suited to odd shaped items.

In another approach, the article is suspended around a structure by attaching elastic cords or other tension type devices. The structure may be separate from or combined into the external container. This approach is especially useful in withstanding large shipping and handling shock loads with minimum transfer of the load to the article being shipped.

All the above described approaches rely upon one or more of the following techniques:

(1) the article is attached to rigid, protective packaging materials, or (2) the article is cushioned by loosely fitting wrap, filled or crushable packing material, or (3) the article is protected by rigid/crushable adjoining package material.

All of these approaches have the following limitations:

Unless special provisions are made, use of flexible packing materials is difficult, requiring refill of loose material, reattachment or reclosable rigid packaging material designs.

Multiple articles require more than just larger containers, necessitating added attachment, separators (especially for loose fill options) and/or added rigid packing materials.

Many different packings are required to be stocked if different items are to be shipped.

Filling and closing time/costs are significant.

SUMMARY OF THE INVENTION

The principal and secondary objects of the invention are:

To provide a packing which suspends a fragile article without attachment to the article;

To provide a means to center and suspend the article below the plane of the frame To provide a packing which provides an elastic, floating support and limits shipping and handling loads transmitted to the fragile article in specific directions to a specific upper limit;

To provide a packing which does not always require, but allows a separate rigid material spacer or structure within the container;

To provide protection from dust and other contaminants;

To provide a packing which limits loads transferred to the article being shipped;

To provide a packing which provides stand off within the package, but can be stored flat;

To provide a packing which allows the article to be visually inspected without disassembly;

To provide a universal packing, adaptable to many shapes and sizes which reduces filling times; and To provide a low cost/weight packing which does not require special post-packing treatment.

These and other objects are achieved by sandwiching the article between two pliable and stretchable membranes, which are each attached to a supporting frame. The frames have a central opening over which the pliable material is attached. If the article rests on one membrane by gravity, the pliable membrane acts to self center the article and suspend the article below the plane of attachment upon stretching of the membrane. The frames are attached to each other or may be biased towards each other by the external container to maintain a high-friction contact between the pliable membranes and the article to be shipped. Multiple items may be held between the pliable materials without separators as long as sufficient space is available between articles and within frame openings. The technique does not require attachment of the article since the pression of two pliable membranes against the article is sufficient to immobilize it. The pliable membrane may even be punctured (accidentally or otherwise) by sharp points on the article to be shipped without compromising structural integrity and even further limiting loads on the sharp protrusion. If not punctured, sharp points on the article cause the membrane to stretch more at these points, which further distributes the load. The fragile article may also be protected against dust and other contaminants by the pliable membranes, even if punctured as the membrane remains tight around the puncture. The pliable membranes remain flexible and are not heated, post treated or preformed to protect the article as shipping and handling loads are transmitted in any direction by tension of the pliable membranes and friction between the membranes and the article. Large transient drop and/or shock loads to the fragile article are limited by the trampoline like action of the membrane in one direction and friction resistance/deformation and ultimate movement of the article between the membranes in other directions, at least until the article moves to contact an adjacent article or the edge of the frames. Because the pliable materials are flexible and are not heat or vacuum shrunk to tightly wrap around the article., the shocks, shipping and handling loads (up to the friction limit just described) are distributed along the contacting surfaces of the fragile article. If the pliable materials are transparent, inspections of the article is simplified, and aesthetic appeal to the customer can be maintained. In another embodiment, the frames and stretched pliable membrane are combined with covers to form a single piece shipper.

DESCRIPTION OF THE PREFERRED EMBODIMENT OF THE INVENTION

Figure 1:
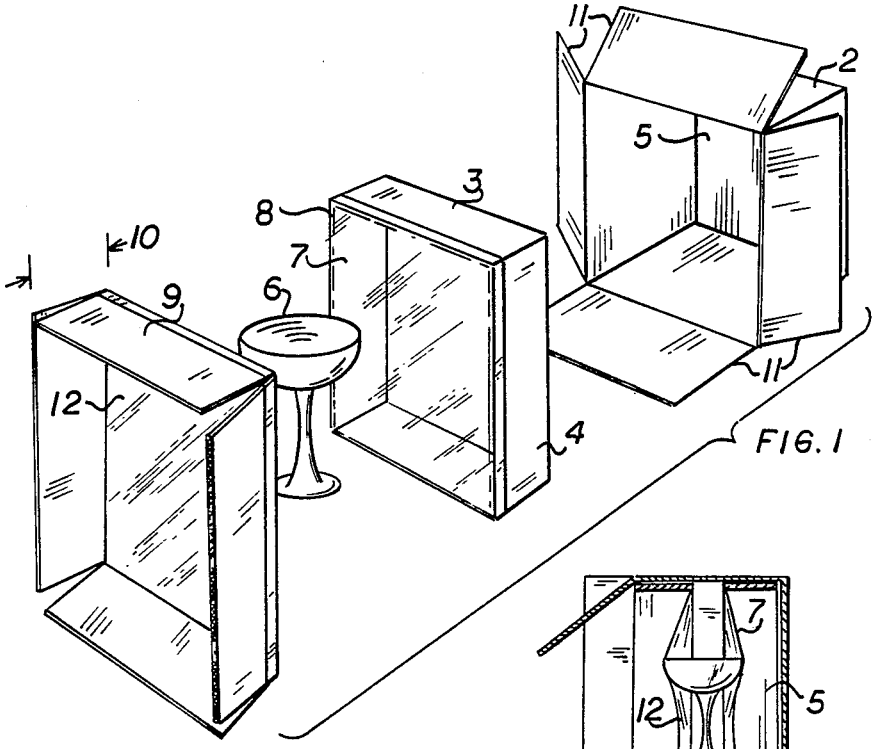
FIG. 1 shows an exploded perspective view of a sheet packing of a glass goblet within a box container.

FIG. 1 shows a exploded perspective view of a sheet packing of a glass goblet within a box container. Rigid or semi-rigid shipping box 2 can be made from cardboard, plastic or other appropriate materials, providing the structural integrity to withstand shipping and handling loads. First frame 3 fits within shipping container or box 2, resting first frame's rear face 4 against rear face 5 of box 2. First frame 3 may be made from a strip of cardboard or other rigid or semi-rigid material, but does not have to be continuous, thus it can be composed of four separate strips of rigid material. A space or opening large enough to pass the article 6 is provided in frame 3. A first sheet of pliable material 7 is shown as transparent in this embodiment, but is not required to be transparent. The sheet 7 may be made from a resilient laminate, woven fabric, netting or puncturable elastomeric film. Puncturable film would allow sharp protrusions of article 6 to puncture the film, but not fully tear the material. Pliable and/or stretchable material 7 is attached over the front face 8 of first frame 3 around the edges. Attachment does not have to completely attach all contacting portions of the pliable material to the frame. Attachment may be by means of glue or other adhesive or can rely on the pliable material's contact properties grabbing the edges of first frame 3 after initial stretching. Article or solid object 6 being shipped in this embodiment is a fragile glass goblet.

Second frame 9 also provides an opening large enough to pass article 6, and is similar in shape and construction to first frame 3. The depth 10 of second frame 9 can be altered by the frame flaps shown which also allow the frame to be stored flat prior to use. Second frame depth 10 is selected to resiliently fill shipping box 2 in conjunction with first frame 3 and article 6, between rear face 5 and the four top face flaps 11 of box 2, when shipping box is closed. A second pliable sheet 12 is stretched over the face of second frame 9 attached to its periphery. When second frame 9 is held against article 6 and first frame 3, the pliable materials deform around article 6 which is now located within the central openings of both frames. The pliable material is not shrunk or vacuum sealed against article 6, but flexibility of sheets 7 and 12 spread the contact area over a significant portion of article 6, and suspend the article by friction between the pliable sheets.

Figure 2:
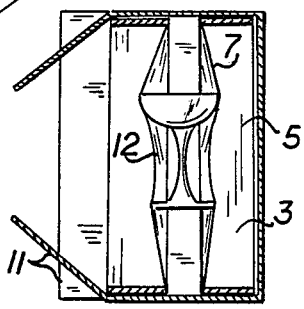
FIG. 2 shows a side cross sectional view of the sheet packing suspending the glass goblet article.

FIG. 2 shows a side cross sectional view of the sheet packing suspending the glass goblet article. Shipping box 2 encloses the packing and article. Shipping and handling loads are transferred from box 2 to frames 3 and 9 which are immobilized in box 2. Goblet 6 is suspended by friction between pliable sheets 7 and 12 pressed against the article 6 by frames 3 and 9 held in place by rear face 5 and front flaps 11 of box 2. The article 6 can translate between pliable sheets 7 and 12 if loads in his direction exceed the frictional force limits. Loads in this direction below the frictional limit and loads in other directions are absorbed by the pliable/-flexible nature of the membrane, acting as a spring to absorb shocks.

Figure 3:
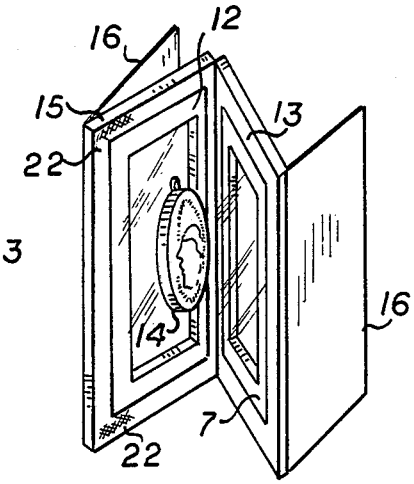
FIG. 3 shows a perspective view of an alternate configuration mailer about to suspend a breakable wall plaque.

FIG. 3 shows a perspective view of an alternate configuration mailer about to suspend a breakable wall plaque. Mailer first frame 13 has a first pliable material 7 stretched over one face of frame having an opening large enough to pass shipping object 14, in this embodiment, a breakable wall plaque. A mailer second frame 15 is similar in construction, having a second pliable sheet 12 stretched over the face and opening adjoining the first pliable material 7. Two mailer flaps 16 may be integral part of the frame construction or may be attached to the mailer frames which are also bonded together by adhesive 22 to form a single piece construction mailer. The thickness or depth of the mailer frames need not fully enclose the article 14 being shipped, as flaps 16 can be formed to provide additional thickness and protection. Material of mailer frames and flaps in this embodiment can be cardboard, foam core material or other treated paper product. If flap is crushable, additional protection of the article is achieved.

Figure 4:
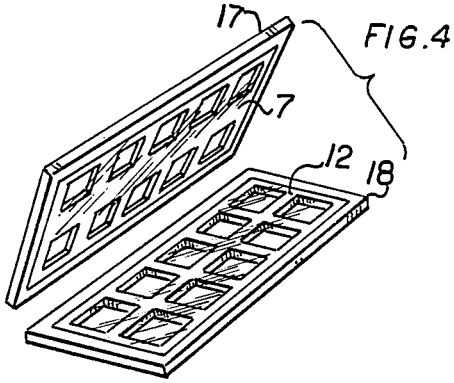
FIG. 4 shows a sheet packing suspending multiple small items.

FIG. 4 shows a sheet packing capable of suspending multiple small items to be shipped. Multiple first frame 17 contains multiple openings which can pass the multiple articles, such as sensitive electronic chips, to be shipped (articles not shown for clarity in this figure). First pliable material 7 is stretched over one face of first frame 17, and attached to first frame 17. Second frame 18 is of similar construction, having a second pliable material 12 stretched over a face of second frame 18. With the frame 18 in a horizontal position, articles placed in the openings will tend to self center and stretching of the pliable material will suspend the center of the article below the plane of the frame. The two frames can then be bought and held together in a face-to-face alignment which captures and immobilizes the articles sandwiched therebetween. The frames 17 and 18 normally would be attached as diecut and scored to fold together.

Figure 5:
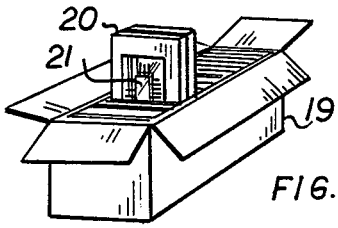
FIG. 5 shows a shipping container with multiple sheet packings.

FIG. 5 shows an alternate shipping container with multiple sheet packings. If article are thinner than walls of frames, there is no need for spacers or slots. If articles exceed the frame thickness, multiple shipping container 19 can be slotted on the inside to retain several individual sheet packings 20. Sheet packings are similar to the mailing frames shown in FIG. 3, with or without flap covers 16, enclosing small articles to be shipped 21, such as an electronic chip. Slots in container 19 can hold frames of sheet packings against each other, or the frames may be adhesively attached to each other to form the sheet packing prior to inserting into multiple shipping container 19.

The devices and techniques described above can be adapted to accommodate a great variety of articles and container configurations. For example, the thickness or depth of the sheet-supporting frame, the spacing between frames and the contour of the frame can be infinitely varied. The frame may be angular or arcuate, closed or open-ended and held together by outer frames and as illustrated in FIG. 1 or by spacer bracket or bonding material as described in connection with the embodiment of FIG. 3.

While the preferred embodiment of the invention has been shown and described, changes and modifications may be made therein within the scope of the appended claims without departing from the spirit and scope of this invention.

What is claimed is:

1. A device for packaging a solid object which comprises:

a first element comprising a first frame defining a first central opening and a first sheet of pliable material stretched over said first central opening and attached to said frame;

a second element comprising a second frame generally commensurate with said first frame, having a second central opening and a second sheet of pliable material stretched over said second central opening an attached to one face of said second frame; and means for holding said first and second elements in symmetrical alignment and for placing said sheets against opposite sides of said object sandwiched therebetween and with sufficient pressure to hold the object and limit its movement in relation to said device when said device is subject to impacts from various directions; wherein said means for holding comprise a shipping container enclosing said elements;

each of said frames being shaped and dimensioned to peripherally contact the inner walls of said container; and wherein each of said frames has a plurality of peripheral foldable flaps;

said flaps being shaped and dimensioned to space said frame apart from one of said walls.

2. The device of claim 1, wherein said sheets are made from woven fabric.

3. The device of claim 1, wherein said sheets are made from netting.

4. The device of claim 1 wherein said membrane is transparent.

5. The device of claim 1, wherein said sheets are made from puncturable elastomeric films.

6. The device of claim 1, wherein said elements and means for holding, are shaped and dimensioned to produce a dust and water barrier.

7. The device of claim 7 wherein more than one said objects are sandwiched between said elements by said means for holding said elements.

8. A device for packaging a solid object which comprises:

a first element comprising a first frame defining a first central opening and a first sheet of pliable material stretched over said first central opening and attached to said frame;

a second element comprising a second frame generally commensurate with said first frame, having a second central opening and a second sheet of pliable material, stretched over said second central opening and attached to one face of said second frame; and means for holding said first and second elements in symmetrical alignment and for placing said sheets against opposite sides of said object sandwiched therebetween and with sufficient pressure to hold the object and limit its movement in relation to said device when said device is subject to impacts from various directions; and a flap attached to one edge of said first element, said flap being shaped and dimensioned to cover said first element after said solid object is in said intimate contact with said sheets.

9. A device for packaging a solid object which comprises:

a first element comprising a first frame defining a first central opening and a first sheet of pliable material stretched over said first central opening and attached to said frame;

a second element comprising a second frame generally commensurate with said first frame, having a second central opening and a second sheet of pliable material stretched over said second central opening and attached to one face of said second frame;

means for holding said first and second elements in symmetrical alignment and for placing said sheets against opposite sides of said object sandwiched therebetween and with sufficient pressure to hold the object and limit its movement in relation to said device when said device is subject to impacts from various directions; and wherein each of said elements contains a plurality of openings, each of said openings large enough to pass said solid object.

10. The device of claim 1, wherein said means for holding are shaped and dimensioned to force said frames against and in intimate contact with each other.

11. The device of claim 1, wherein said attachment of said first pliable material to said first frame is an adhesive bond.

12. The device of claim 1, wherein said attachment of said first pliable material to said first frame is the surface contact resistance and stretchable properties of said pliable material.

* * * * *

US004852743C1

(12) EX PARTE REEXAMINATION CERTIFICATE (4857th)

United States Patent

Ridgeway

(10) Number: US 4,852,743 C1

(45) Certificate Issued: Oct. 7, 2003

(54) MEMBRANE PACKING

(75) Inventor: Louis H. Ridgeway, Bonita, CA (US)

(73) Assignee: Sealed Air Corporation, Saddle Brook, NJ (US)

Reexamination Request:
No. 90/006,230, Mar. 4, 2002

Reexamination Certificate for:

| | |
|---|---|
| Patent No.: | **4,852,743** |
| Issued: | **Aug. 1, 1989** |
| Appl. No.: | **07/162,215** |
| Filed: | **Feb. 29, 1988** |

(51) Int. Cl.[7] ..... B65D 81/02

(52) U.S. Cl. ..... 206/583; 206/521; 206/526; 206/591; 206/592

(58) Field of Search ..... 206/426, 485, 206/521, 526, 527, 583, 589, 591, 592

(56) References Cited

U.S. PATENT DOCUMENTS

| | | | | |
|---|---|---|---|---|
| 1,456,098 A | | 5/1923 | Doane | |
| 2,134,908 A | | 11/1938 | Copeman | |
| 2,501,570 A | * | 3/1950 | Larsen | 206/583 |
| 2,749,012 A | | 6/1956 | Beach | |
| 3,051,345 A | | 8/1962 | Flynn | |
| 3,221,872 A | | 12/1965 | Wood | |
| 3,381,873 A | | 5/1968 | Hirota | |
| 3,404,827 A | | 10/1968 | Carmody | |
| 3,487,921 A | | 1/1970 | Barth | |
| 3,521,743 A | * | 7/1970 | Sposito, Jr. | 206/583 |
| 3,523,863 A | | 8/1970 | Juhos | |
| 3,552,595 A | | 1/1971 | Gerner et al. | |
| 3,692,264 A | | 9/1972 | Bulkhard | |
| 3,752,301 A | | 8/1973 | Bluemel | |
| 3,853,220 A | * | 12/1974 | Luray | 206/583 |
| 4,087,003 A | | 5/1978 | Adamek | |
| 4,173,286 A | * | 11/1979 | Sanko | 206/589 |
| 4,491,225 A | * | 1/1985 | Baillod | 206/583 |
| 4,606,459 A | * | 8/1986 | Luray | 206/583 |
| 4,606,460 A | * | 8/1986 | Luray | 206/583 |
| 4,754,880 A | | 7/1988 | Techrani | |

FOREIGN PATENT DOCUMENTS

| | | | |
|---|---|---|---|
| AU | 15277/47 | | 11/1947 |
| AU | 51818/69 | | 9/1970 |
| AU | 13949/70 | | 10/1971 |
| AU | 26861/71 | | 9/1972 |
| DE | 2723175 | | 5/1977 |
| DE | 2654231 | A1 | 6/1978 |
| DE | 3340155 | | 4/1984 |
| DE | 3440169 | A1 | 5/1986 |
| GB | 475299 | | 11/1937 |
| GB | 1224493 | | 3/1971 |
| IT | 380271 | | 4/1939 |
| JP | 48-112780 | | 12/1973 |
| JP | 49-18975 | | 2/1974 |
| JP | 49-18975-01 | * | 2/1974 |
| JP | 53-9587 | | 3/1978 |
| JP | 53-135796 | | 11/1978 |
| JP | 58-151579 | | 10/1983 |
| SU | 685567 | | 9/1979 |
| SU | 827346 | | 5/1981 |
| SU | 1006318 | | 3/1983 |

* cited by examiner

*Primary Examiner*—Jim Foster

(57) ABSTRACT

A pair of rigid frames having central openings are each covered with a pliable and stretchable material which is forced in intimate contact with a fragile article to be handled. Central openings allow passage of the fragile article which is suspended between the two pliable materials, Stretchable material and friction limits the handling shock loads which may be transmitted to the fragile article in one direction, and cushions loads in other directions. Frames can be positioned within an enclosure package so that motion of the fragile article during handling can be tolerated. A single pair of pliable covered frames can serve as packing for a wide variety of solid materials, including multiple items, with no further protection required.

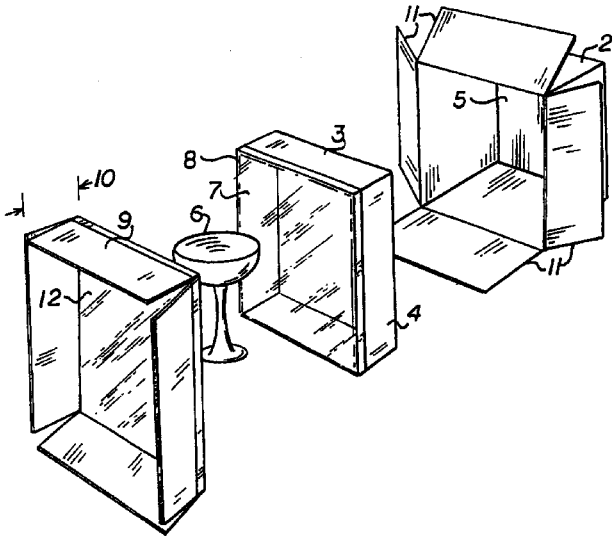

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 7 and 9 are cancelled.

Claims 1, 8 and 10 are determined to be patentable as amended.

Claims 2–6, 11 and 12, dependent on an amended claim, are determined to be patentable.

New claims 13–27 are added and determined to be patentable.

1. A device [for packaging a solid object] *and at least one solid object packaged thereby,* which comprises:

a first element comprising a first frame defining a first central opening and a first sheet of pliable material stretched over said first central opening and attached to said frame;

a second element comprising a second frame generally commensurate with said first frame, having a second central opening and a second sheet of pliable material stretched over said second central opening an attached to one face of said second frame; and means for holding said first and second elements in symmetrical alignment and for placing said sheets against opposite sides of said *at least one* object sandwiched therebetween and with sufficient pressure to hold [the] *said at least one* object and limit its movement in relation to said device when said device is subject to impacts from various directions; wherein said means for holding comprise a shipping container enclosing said elements;

each of said frames being shaped and dimensioned to peripherally contact the inner walls of said container; and wherein each of said frames has a plurality of peripheral foldable flaps;

said flaps being shaped and dimensioned to space said frame apart from one of said walls*;*

*said shipping container enclosing said first and second elements, said at least one object being sandwiched between said first and second sheets; and wherein:*

*said first and second sheets are spaced apart from each other and not in contact with each other; and*

*said first and second elements are solely spaced apart within said container by said at least one object.*

8. A device for packaging a solid object which comprises:

a first element comprising a first frame defining a first central opening and a first sheet of pliable material stretched over said first central opening and attached to said frame;

a second element comprising a second frame generally commensurate with said first frame, having a second central opening and a second sheet of pliable material, stretched over said second central opening and attached to one face of said second frame*, wherein said first and second elements are hingedly attached to each other along a hinge edge*; and means for holding said first and second elements in symmetrical alignment and for placing said sheets against opposite sides of said object sandwiched therebetween and with sufficient pressure to hold the object and limit its movement in relation to said device when said device is subject to impacts from various directions; and a *planar sheet* flap *hingedly* attached to [one] *an* edge of said first element *opposite said hinge edge*, said *planar sheet* flap being shaped and dimensioned to cover *a major portion of* said first element after said solid object is in said intimate contact with said sheets.

10. The device of claim 1, wherein said means for holding are shaped and dimensioned to force said frames against and in intimate contact with [each other] *said at least one object*.

*13. The device of claim 1 wherein:*

*said first central opening is large enough to pass said at least one object without touching said first frame; and*

*said second central opening is large enough to pass said at least one object without touching said second frame.*

*14. The device of claim 1 wherein said at least one object is one object.*

*15. The device of claim 1 wherein said at least one object comprises more than one object.*

*16. The device of claim 1 wherein said first and second sheets comprise a resilient material and said at least one object contacts only said resilient material of said first and second sheets.*

*17. The device of claim 1 wherein:*

*said first central opening is the sole opening defined by the first frame large enough to pass said at least one object without touching said first frame; and*

*said second central opening is the sole opening defined by the second frame large enough to pass said at least one object without touching said second frame.*

*18. The device of claim 8 wherein said holding means comprises adhesive.*

*19. The device of claim 18 wherein said adhesive is on at least one of the first and second elements.*

*20. A device for packaging a solid object which comprises:*

*a first element comprising a first frame defining a first central opening and a first sheet of pliable material stretched over said first central opening and attached to said frame;*

*a second element comprising a second frame generally commensurate with said first frame, having a second central opening and a second sheet of pliable material, stretched over said second central opening and attached to one face of said second frame, wherein said first and second elements are hingedly attached to each other along a hinge edge; and*

*means for holding said first and second elements in symmetrical alignment and for placing said sheets against opposite sides of said object sandwiched therebetween and with sufficient pressure to hold the object and limit its movement in relation to said device when said device is subject to impacts from various directions;*

*a first planar sheet flap hingedly attached to an edge of said first element opposite said hinge edge, said first planar sheet flap being shaped and dimensioned to cover said first element after said solid object is in said intimate contact with said sheets; and*

*a second planar sheet flap hingedly attached to an edge of said second element opposite said hinge edge, said second planar sheet flap being shaped and dimensioned to cover said second element after said solid object is in said intimate contact with said sheets.*

*21. A device for packaging a solid object which comprises:*

*a first element comprising a first frame defining a first central opening and a first sheet of pliable material stretched over said first central opening and attached to said frame;*

*a second element comprising a second frame generally commensurate with said first frame, having a second central opening and a second sheet of pliable material stretched over said second central opening and attached to one face of said second frame, wherein said first and second elements are hingedly attached to each other along a hinge edge; and*

*means for holding said first and second elements in symmetrical alignment and for placing said sheets against opposite sides of said object sandwiched therebetween and with sufficient pressure to hold the object and limit its movement in relation to said device when said device is subject to impacts from various directions; and*

*a planar sheet flap hingedly attached to an edge of said first element other than said hinge edge, said planar sheet flap being shaped and dimensioned to cover a major portion of said first element after said solid object is in said intimate contact with said sheets.*

*22. The device of claim 21 wherein said holding means comprises adhesive.*

*23. The device of claim 22 wherein said adhesive is on at least one of the first and second elements.*

*24. The device of claim 21 further comprising a second planar sheet flap hingedly attached to an edge of said second element other than said hinge edge, said second planar sheet flap being shaped and dimensioned to cover said second element after said solid object is in said intimate contact with said sheets.*

*25. A device for packaging a solid object which comprises:*

*a first element comprising a first frame defining a first central opening and a first sheet of pliable material stretched over said first central opening and attached to said frame;*

*a second element comprising a second frame generally commensurate with said first frame, having a second central opening and a second sheet of pliable material stretched over said second central opening and attached to one face of said second frame; and*

*means for holding said first and second elements in symmetrical alignment and for placing said sheets against opposite sides of said object sandwiched therebetween and with sufficient pressure to hold said object and limit its movement in relation to said device when said device is subject to impacts from various directions; wherein said means for holding comprise a shipping container enclosing said elements;*

*each of said frames being shaped and dimensioned to peripherally contact the inner walls of said container; and*

*wherein each of said frames has a plurality of peripheral foldable flaps;*

*said flaps being shaped and dimensioned to space said frame apart from one of said walls; and*

*wherein said first central opening extends to the full periphery of said first frame.*

*26. The device of claim 25 wherein said second central opening extends to the full periphery of said second frame.*

*27. The device of claim 25 wherein said first and second sheets are spaced apart from each other and not in contact with each other when said shipping container encloses said first and second element to sandwich the object between the first and second sheets.*

* * * * *